US007414225B2

(12) United States Patent
Yoshidome et al.

(10) Patent No.: US 7,414,225 B2
(45) Date of Patent: Aug. 19, 2008

(54) COOKING HEATER

(75) Inventors: Akihiro Yoshidome, Osaka-fu (JP); Masayuki Iwamoto, Osaka-fu (JP)

(73) Assignee: Sharp Kabushiki Kaisha, Osaka (JP)

( * ) Notice: Subject to any disclaimer, the term of this patent is extended or adjusted under 35 U.S.C. 154(b) by 124 days.

(21) Appl. No.: 11/303,148

(22) Filed: Dec. 16, 2005

(65) Prior Publication Data

US 2006/0163239 A1 Jul. 27, 2006

(30) Foreign Application Priority Data

Jan. 27, 2005 (JP) ..... 2005-019371

(51) Int. Cl.
*A21B 1/00* (2006.01)
*G05D 3/00* (2006.01)

(52) U.S. Cl. ..... 219/392; 318/466

(58) Field of Classification Search ..... 219/390, 219/391, 402, 403; 318/461, 466, 467, 253–300
See application file for complete search history.

(56) References Cited

U.S. PATENT DOCUMENTS 5,929,580 A * 7/1999 Mullet et al. ..... 318/466
6,208,102 B1 * 3/2001 Kikuchi et al. ..... 318/466
6,642,486 B1 * 11/2003 Anderson et al. ..... 219/411
6,989,767 B2 * 1/2006 Fitzgibbon et al. ..... 340/908.1

FOREIGN PATENT DOCUMENTS

| | | |
|---|---|---|
| JP | 03-045820 | 2/1991 |
| JP | 06-109257 | 4/1994 |
| JP | 11-237053 | 8/1999 |

* cited by examiner

*Primary Examiner*—Sang Y Paik
(74) *Attorney, Agent, or Firm*—Renner, Otto, Boisselle & Sklar, LLP

(57) ABSTRACT

In a cooking heater having an automatically opening/closing door, when a lock determination unit detects that transmission of a torque of a driving unit is stopped by detecting an abrupt deceleration, which suggests that an obstacle to the movement of an opening/closing door that is opening/closing is detected, an operation instructing unit operates the opening/closing door in an opposite direction. Further, in the closing operation of the opening/closing door, when an opening/closing door position calculating unit detects the position ahead of a completely closed position at which the opening/closing door is completely closed by the action of an intermediate switch during the closing operation of the opening/closing door, the operating instruction unit lowers the closing speed of the opening/closing door of the operation instruction unit to prevent such a situation that a user's finger or hand is caught in the opening/closing door.

5 Claims, 7 Drawing Sheets

COOKING HEATER

The present application is based on and claims priority of Japanese patent application No. 2005-019371 filed on Jan. 27, 2005, the entire contents of which are hereby incorporated by reference.

BACKGROUND OF THE INVENTION

1. Field of the Invention

The present invention relates to a cooking heater for heating an object to be cooked that is placed in a cooking space of the cooking heater through an open door with the door automatically opening/closing.

2. Description of the Related Art

Various cooking heaters having a front door have been hitherto proposed. Aside from such heaters, a sliding-drawer type cooking heater has been proposed. The sliding-drawer type cooking heater is suitable for a relatively large structure. Hence, the sliding-drawer type cooking heater has been used as a part of a built-in kitchen. In parallel with the diversification and unitization of cooking devices, there has been proposed a cooking device that integrates a cooktop, a drawer-type microwave oven, and an electric oven.

To give an example of the sliding-drawer type cooking heater, there is a heater having a sliding function in which a bottom that is continuous with a front door smoothly slides over a heater main body and the bottom is moved together with the door by transmitting a torque of a motor provided in the heater main body by use of a transmitting device such as a rack and pinion mechanism (see Japanese Unexamined Patent Application Publication No. 3-45820 (p. 3, 1.5 in the upper left column'to 1.16 in the upper right column, FIGS. 2 to 4). A door opening/closing mechanism includes a latching device for keeping the door closed, a door opening/closing switch, and a controlling circuit for rotating a motor to open/close the door in response to a signal from the door opening/closing switch. When the door opening/closing switch is pressed, the latch is automatically opened, and in addition, the door starts opening/closing together with the door by means of a driving force of the motor.

As another example of the sliding-drawer cooking heater, there is a cooking heater having a drawer for receiving an object to be heated, which is provided slidably over a heater main body. When the heater detects that the drawer is pulled out, an electromagnet provided on the bottom surface of the heater main body is excited so as to attract a metal turntable supporting a heating device (see Japanese Unexamined Patent Application Publication No. 6-109257 (paragraph [0010], FIG. 1). The electromagnet attracts the metal turntable at a timing when the drawer is pulled out, so the drawer is prevented from coming off a kitchen counter and toppling on account of losing the weight balance.

As still another example of the sliding-drawer type cooking heater, there is a microwave oven having a sliding-drawer type table (see Japanese Unexamined Patent Application Publication No. 11-237053, paragraphs [0030] to [0035], FIG. 1). In this microwave oven, an open-topped heating container can be pulled out from a main-body case, and the heating container and a cover portion are provided on the main-body case for covering the container to confine the microwaves and define a heating chamber. This electric oven prevents a leakage of radiowaves owing to the provision of a choke cavity between the periphery of the opening of the heating container and the cover portion opposite to the periphery.

The applicants of the present invention propose a cooking heater having a drawer which can be pulled out from a heater main body, for accommodating an object to be heated, (Japanese Patent Application Nos. 2004-7384 and 2004-7385). According to the heater proposed in Japanese Patent Application No. 2004-7384 by the applicants of the present invention, it is possible to reduce a manufacturing cost without requiring expensive parts and material of high heat resistance and flame resistance. In addition, the heater is structured such that a sliding mechanism is not subjected to the radiowaves applied to the heating chamber, thereby eliminating the danger of electrical discharge due to the application of the microwaves. According to the heater proposed in Japanese Patent Application No. 2004-7385, it is possible to prevent the occurrence of a situation in which vibrations from an opening/closing operation are transmitted to an object being heated, resulting in ejection of an overheated liquid in a steam form at a dash due to impacts resulting from the vibrations, whereby a user is scalded. Further, it is possible to control a moving speed of the door to prevent an object being heated from falling down or prevent a liquid component from overflowing due to the impact applied during the opening/closing operation. Further, the moving mechanism can be obtained without requiring expensive parts or material having a high heat resistance and flame resistance, thereby saving the manufacturing cost. In addition, the heater is structured such that a sliding mechanism is not subjected to the radiowaves applied to the heating chamber, thereby eliminating the danger of electrical discharge due to the application of the microwaves.

In the sliding-drawer type cooking heater having an automatically opening/closing door, there is a danger that a user's finger or hand could be accidentally pinched between the door and a heater main body at the time of opening the door. There is another danger that a user could get hit by the door in the course of opening the door. If the door opens/closes at a fixed speed that is low enough to ensure safety even in the case where the user's finger or hand is pinched between the door and the main body or the user gets hit by the door in order to eliminate the above danger, this slow opening/closing operation may irritate a user rather than serve the user.

To that end, in the cooking heater having an automatically opening/closing door, there is a problem remaining to be solved, in terms of preventing the danger inherent in the automatic opening/closing operation.

SUMMARY OF THE INVENTION

Accordingly, the present invention aims at ensuring a smooth operation of an automatic opening/closing door, and minimizing such an impact that occurs when a user's finger is pinched between the door and a heater main body or a user gets hit by the door at the time of closing the door at such speeds to avert a danger.

It is therefore an object of the present invention to provide a cooking heater with an automatic opening/closing door, which does not cause a user to be irritated due to a slow movement, prevents a user's finger or hand from being pinched between a door and a main body at the time of closing the door, and minimizes an impact that occurs when a user bumps his/her finger or hand against the door at the time of opening the door to thereby improve safety for the user.

In order to attain the above object, a cooking heater according to an aspect of the present invention includes an opening/closing door, in which in response to detection of an obstacle to a movement of the opening/closing door that is opening/ closing, the opening/closing door is moved in a direction opposite to the opening/closing direction.

In the case where the obstacle hinders the operation of an opening/closing portion, for example, where a user's finger or hand is caught in the opening/closing door or bumped on the door, the opening/closing door is moved in an opposite direction instead of being stopped. Considering the case where the user's finger or hand is caught in the door at the time of closing the door, for example, the finger or hand seems to be an obstacle from the viewpoint of the opening/closing door (hereinafter in this paragraph, simply referred to as "door") which is closing, even if the door stops, the finger or hand remains stuck, which is dangerous. Thus, when it is detected that the finger or hand is caught in the door, the door is moved in an opposite direction, that is, opening direction, which avoids the danger of an impact being applied to the finger or hand caught in the door, and the finger or hand being caught in the door for a long period. Further, upon opening the door, if a user bumps into the door, the user is not knocked over by the door but may be caught between the door or a piece of furniture that is placed in front of the door. Even if the door stops, the user remains caught, which is dangerous. Hence, also when it is detected that the user is caught in the door, the door is moved in an opposite direction to avoid the danger of being caught in the door.

The cooking heater further includes a motor for generating a torque that is converted into an opening/closing movement of the opening/closing door, in which detection of a lock signal indicating that transmission of the torque from the motor is stopped corresponds to detection of the obstacle. The torque of the motor is monitored to detect the collision against the obstacle at low cost.

In the cooking heater, preferably, the opening/closing door is moved in the opposite direction in accordance with the detection of the obstacle and then the opening/closing door is temporarily stopped. When the obstacle is detected, for example, when the user's finger or hand is caught in the door, the door is moved in the opposite direction and then stopped, and thus separated from the obstacle to wait for the next instruction from the user. Hence, it is possible to secure a higher level of safety for the user even when the obstacle is detected.

A cooking heater according to another aspect of the present invention includes an opening/closing door, in which during a closing operation of the opening/closing door, a closing speed of the opening/closing door is lowered at a position ahead of a completely closed position at which the opening/closing door is completely closed. According to the present embodiment of the cooking heater, just before the opening/closing door is completely closed, that is, at a position where there is a space in which a finger can be caught, the door closing speed is reduced. Therefore, in such a position, the door moves slowly, so even if a finger or hand comes close to being caught in the space between the door and the heater main body, the user can have sufficient time to remove the finger from the space, and when a finger or hand is actually caught in the space, little pain is caused.

The cooking heater with the door closing speed reduced at the position ahead of the completely closed position further includes a plurality of switches provided at each of the completely closed position and the position ahead of the completely closed position, in which the detection switches are actuated by an actuator moving together with the opening/closing operation of the opening/closing door to detect that the opening/closing door reaches the completely closed position and the position ahead of the completely closed position. As a structure for reducing the closing speed of the opening/closing door, detection switches are provided at the position ahead of the completely closed position, and the moving speed of the opening/closing door can be lowered when the detection switches are activated.

The cooking heater with the door closing speed reduced at the position ahead of the completely closed position further includes a motor for generating a torque that is converted into an opening/closing movement of the opening/closing door, wherein it is detected whether the opening/closing door has reached the completely closed position or the position ahead of the completely closed position on the basis of a rotation signal of the motor. If the detection switches are arranged at the position ahead of the completely closed position, when the detection switches cannot operate due to a failure, the position of the opening/closing door is detected by means of the rotation signal of the motor as an effective alternative to the detection switches.

In the cooking heater, the opening/closing door includes a latch structure that secures the opening/closing door at the completely closed position by means of a latch head moving beyond a latch hook, and the closing speed of the opening/closing door, which is lowered, is increased at a position immediately before the completely closed position. With the provision of the latch structure that secures the opening/closing door at the completely closed position, the opening/closing door is prevented from erroneously opening during the cooking under heating without fail. However, in the door with the latch structure, a latch head cannot move beyond the latch head and thus the door cannot be completely closed unless the door closing speed is sufficiently high. Therefore, after the opening/closing door is closed up to the position ahead of the completely closed position, the moving speed is increased again to allow the latch head to move beyond the latch hook. Hence, the opening/closing door can be completely closed.

In the cooking heater according to the present invention, the cooking heater is a sliding-drawer type cooking heater having the opening/closing door, a heating container capable of containing an object to be heated, and a drawer that can be pushed in or pulled out from a heating main body. The drawer of the sliding-drawer type cooking heater has large inertia. With the automatic opening/closing type, there is a possibility that a finger or hand could be tightly caught in the door with the large inertia of the drawer, which is dangerous. It is effective to move the door in the opposite direction upon detection of the collision or reduce the door closing speed at the position ahead of the completely closed position.

In the thus-structured cooking heater according to the present invention, the door opening/closing speed is automatically adjusted to move the opening/closing door in the opposite direction upon detection of an obstacle, so when the obstacle is caught in the opening/closing door that is closing, the opening/closing door is moved in the opposite direction, and the user can immediately remove the finger or hand from the door. If the user bumps into a door that is closing/opening, the collision is detected so as to immediately stop the opening/closing door or move the door in the opposite direction. As a result, it is possible to prevent the danger inherent in the automatic opening/closing operation at the time of opening/closing the door.

DESCRIPTION OF THE PREFERRED EMBODIMENTS

Figure 1:
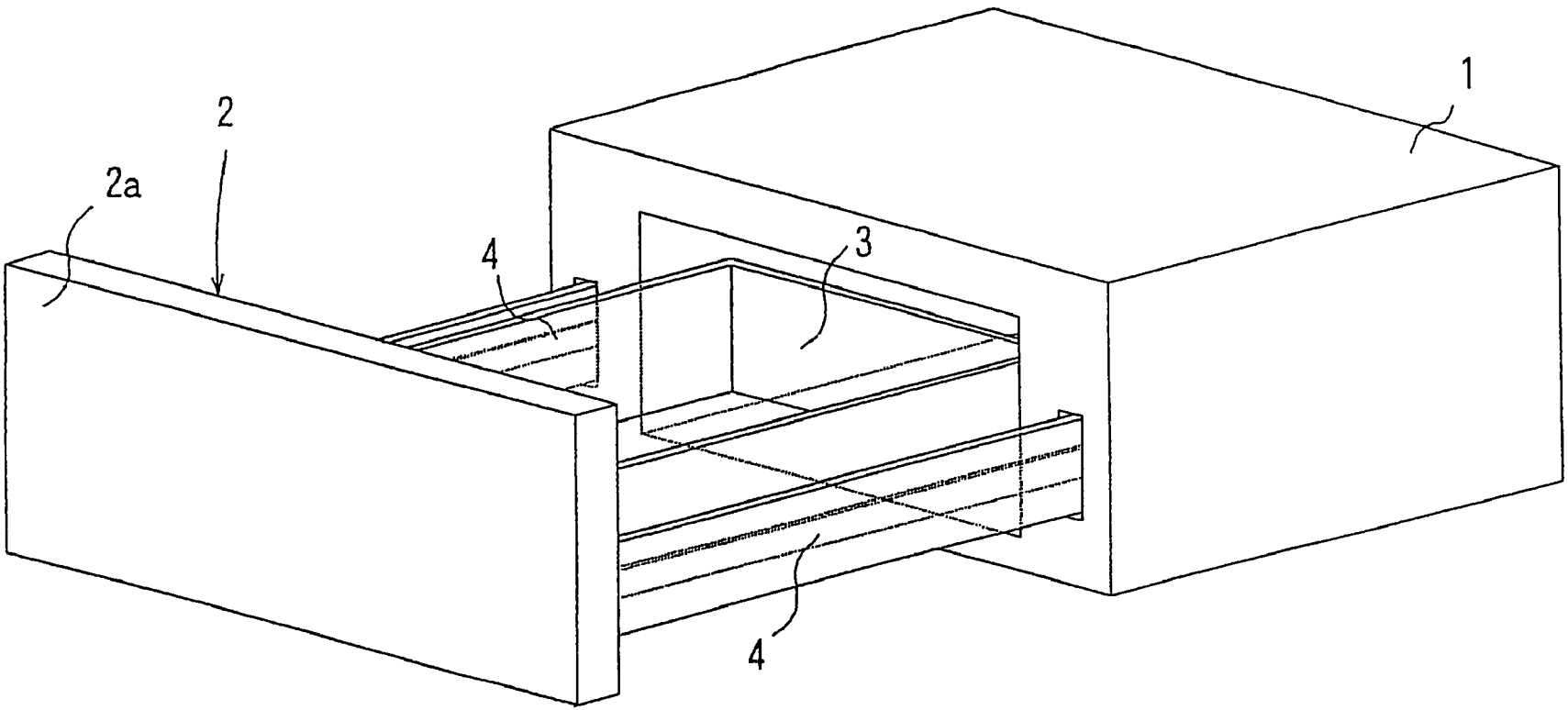
FIG. 1 is a perspective view showing an overall appearance of a cooking heater according to an embodiment of the present invention.
Figure 2:
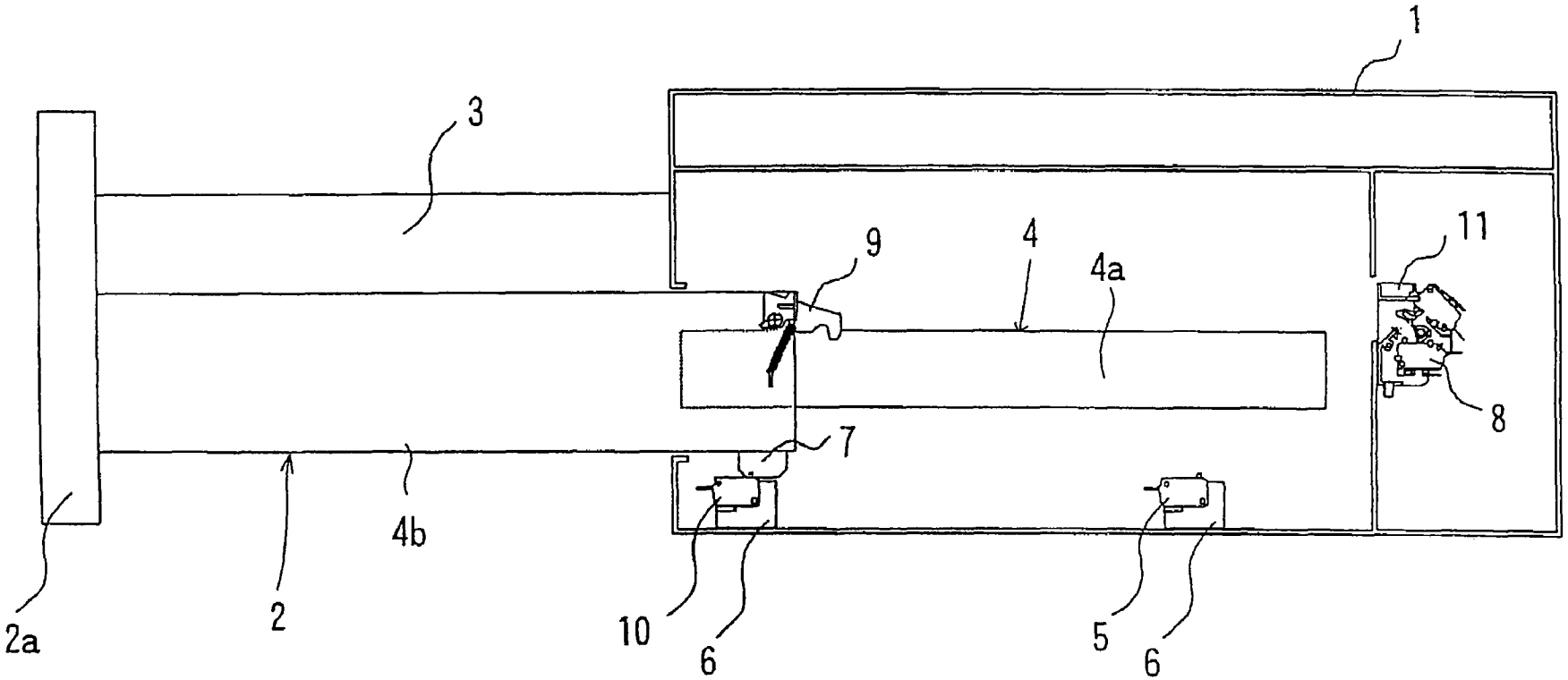
FIG. 2 is a longitudinal sectional view of the cooking heater of FIG. 1.
Figure 3:
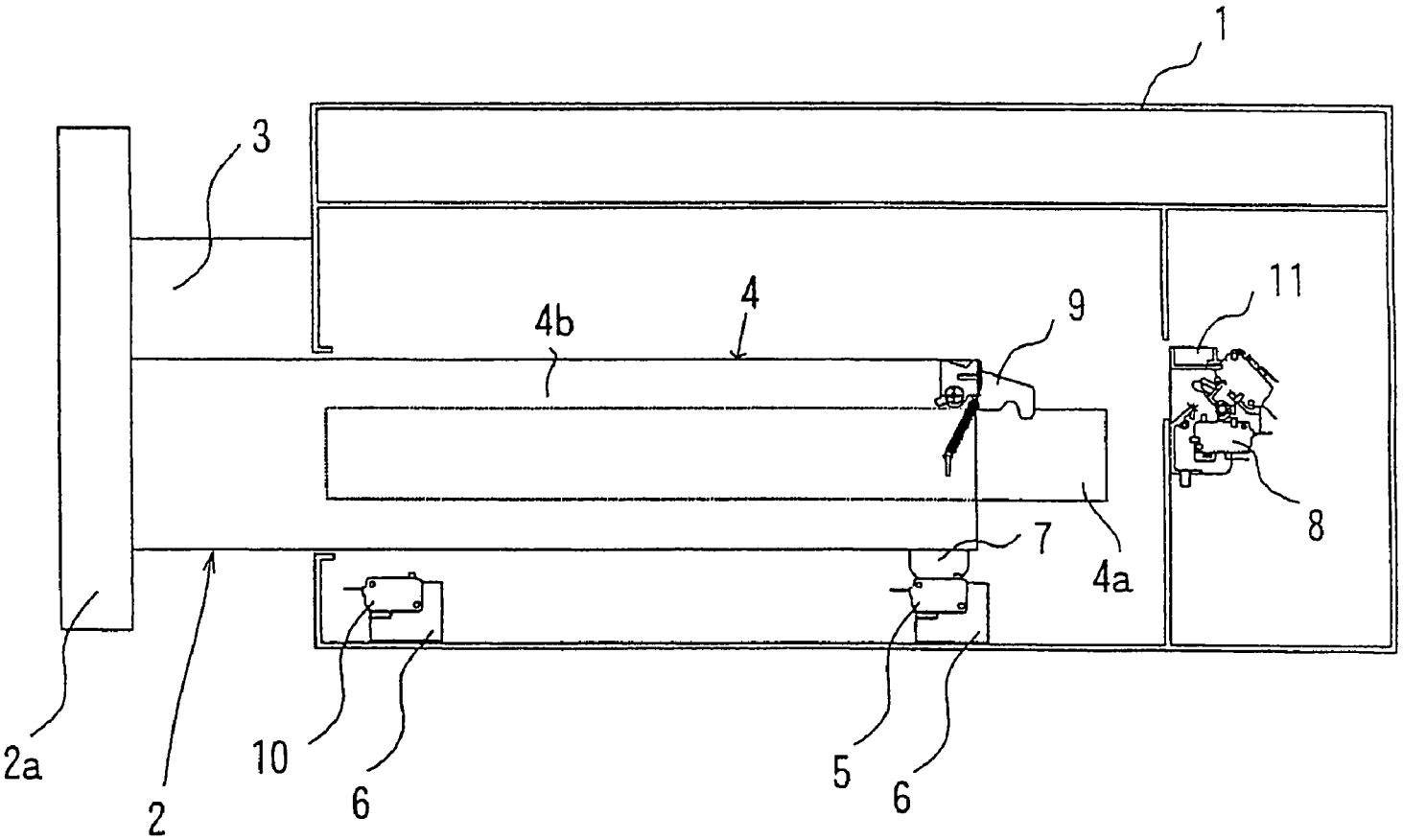
FIG. 3 is a horizontal sectional view of the cooking heater of FIG. 1.

Hereinbelow, a cooking heater according to an embodiment of the present invention will be described with reference to the accompanying drawings. FIG. 1 is a perspective view showing an overall appearance of an embodiment of the cooking heater of the present invention, which is applied to a sliding-drawer type cooking heater. FIGS. 2 to 5 are side views showing a sliding mechanism of the cooking heater of FIG. 1. FIG. 2 shows the sliding mechanism with the door being completely open, FIG. 3 shows the sliding mechanism with the door being almost completely open, and FIG. 5 shows the sliding mechanism with the door being completely closed.

As shown in FIG. 1, the sliding-drawer type cooking heater (hereinafter simply referred to as "cooking heater") includes a heater main body 1 and a drawer 2 that can be pulled out from the heater main body 1. A heating chamber in which the drawer is inserted is defined inside the heater main body 1 for cooking an object to be heated that is placed in the drawer 2. The heating chamber has inner right/left walls, inner upper/lower walls, and an inner back wall but does not have a front wall since the drawer 2 is inserted from the front side.

The drawer 2 moves slidably along the heater main body 1 by means of sliding mechanisms 4 in such a manner that the drawer 2 can be pulled out from the heating chamber of the heater main body 1 in the direction of the arrow (FIGS. 2 and 3). The drawer 2 has an automatic opening/closing door (hereinafter, simply referred to as "door") 2*a* for opening/closing the heating chamber and a heating container 3 for receiving the object to be heated, which is integrated with the door 2*a*. The heating container 3 is composed of a front plate attached to the door 2*a*, right/left side plates extending from the front plate to a back plate, the back plate being connected to the side plates, and a bottom plate connected to the side plates, the back plate defining a container opening at the top. The object to be heated can be placed in or taken out of the heater main body through the opening. In the heater main body 1, although not shown, a microwave generator is arranged around a heating chamber. The microwave generator is composed of a magnetron for generating microwaves and a waveguide for propagating the microwaves from the magnetron. The microwaves from the magnetron propagate through the waveguide and are then applied to the heating chamber from a power supply port.

Figure 4:
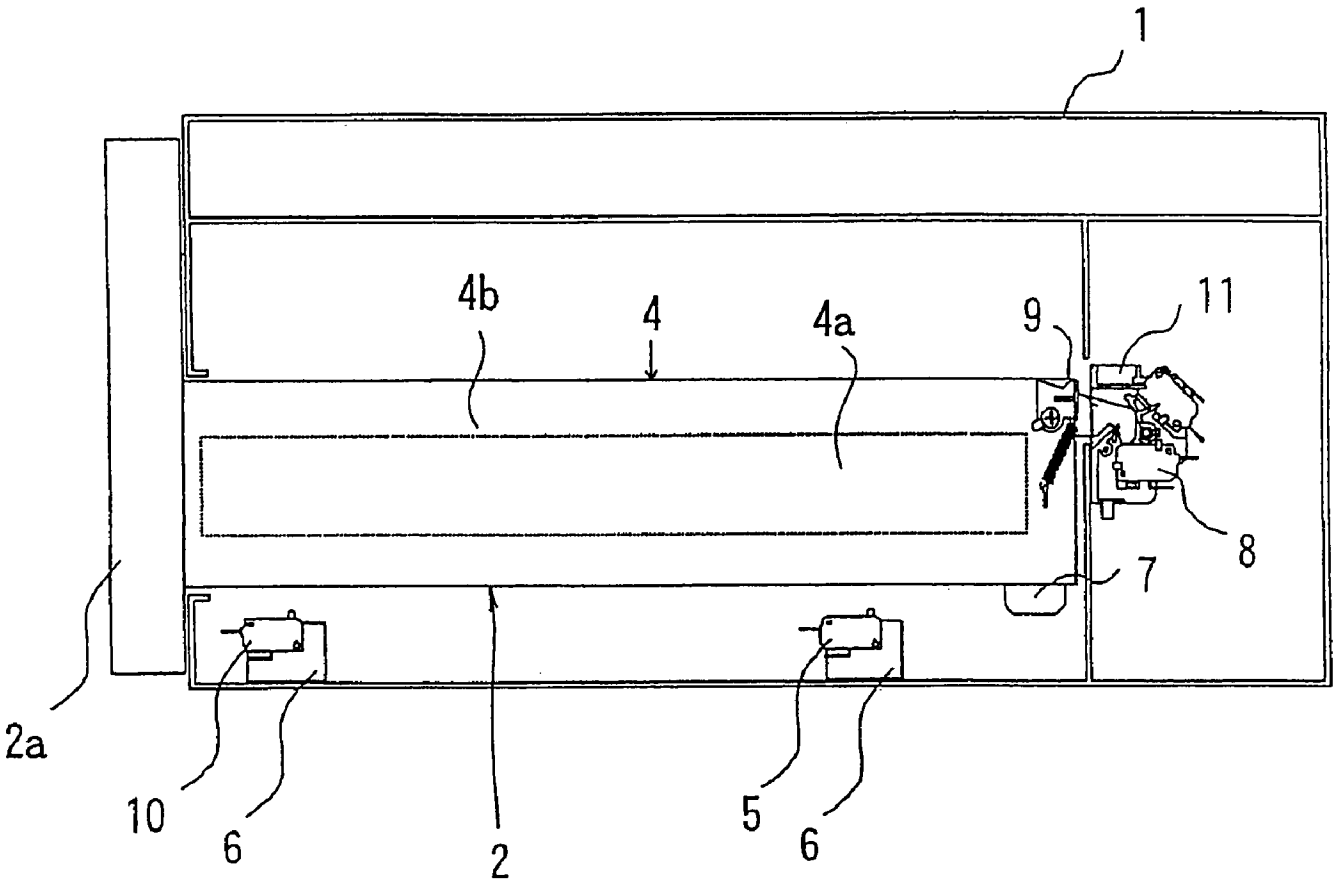
FIG. 4 is a cross-sectional view of the cooking heater of FIG. 1.
Figure 5:
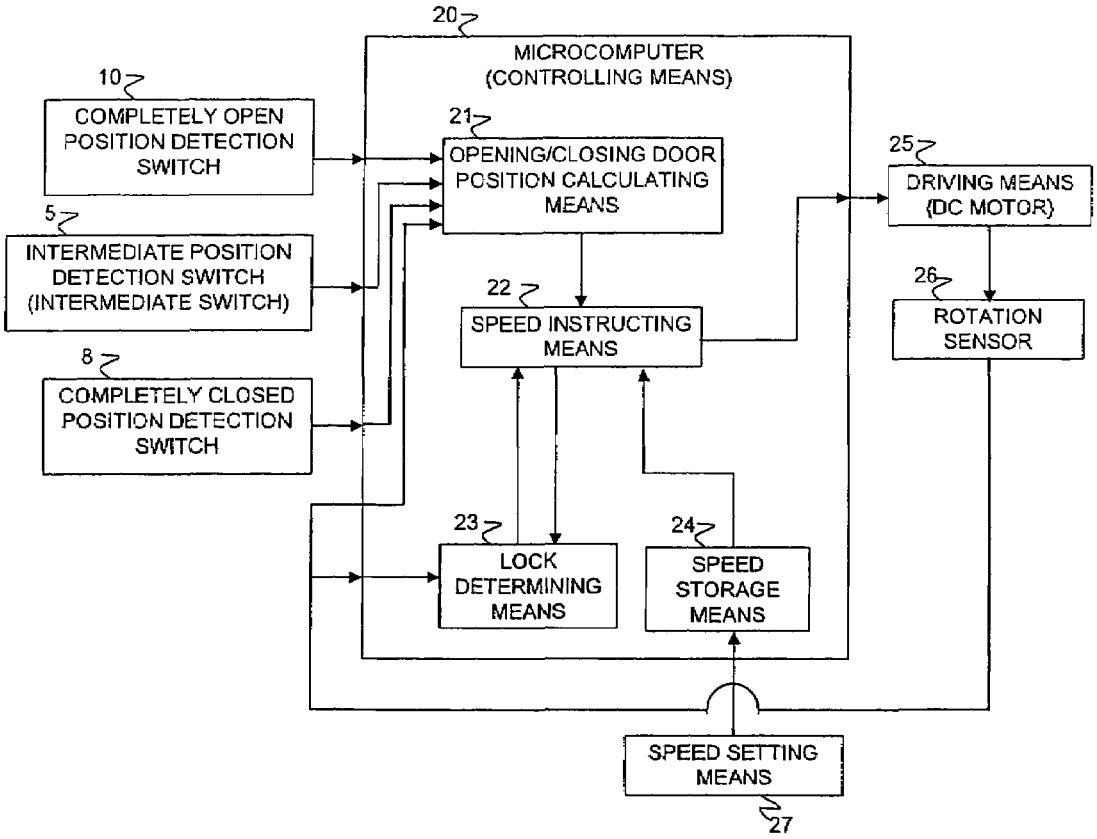
FIG. 5 is a block diagram of the cooking heater according to the embodiment of the present invention.

As shown in FIGS. 2 to 4, the cooking heater includes the nested sliding mechanisms 4 provided on both sides of the heating container 3 including sliding rails along which a movable rail 4*b* can slide relative to a fixed rail 4*a*. The drawer 2 can be moved between a completely open position at which the heating container 3 is completely pulled out from the heating chamber and a completely closed position at which the heating container 3 is completely housed within the heating chamber. When the drawer 2 reaches the completely closed position, the door 2*a* closes the opening of the heating chamber, so that an inner space of the heating chamber is tightly enclosed by means of the inner walls of the heater main body 1 and the drawer 2. The individual sliding mechanisms 4 are provided to a pass-through box formed in the heater main body 1 on the right and left sides of the heating chamber. The fixed rail 4*a* is defined on the outer side of the heating chamber of the pass-through box. The movable rail 4*b* can be engaged with and disengaged from the fixed rail of the pass-through box with the movement of the drawer 2. The drawer 2 can be supported by the heater main body 1 through the sliding mechanisms 4, 4 and stably pulled out from the heating chamber.

A movable lever (latch head) 9 is provided to at least one of the sliding mechanisms 4. The movable lever 9 is preferably provided at the rearmost position of the movable rail 4*b* so as to operate a completely closed position detection switch 8. The movable lever 9 is biased to turn in the clockwise direction of FIGS. 2 and 3. The movable lever 9 can be latched on a latch hook 11 provided on the rearmost position of the heater main body 1 when the drawer 2 is moved to a completely closed position. Further, a completely open position detection switch 1 0 is provided at the foremost position of the pass-through box through a switch attachment angle 6. Further, an intermediate position detection switch (intermediate switch) 5 is attached in the middle of the pass-through box by means of the switch attachment angle 6. An actuator 7 is provided at the rearmost position of the movable rail 4*b*, which is capable of operating the completely open position detection switch 10 and the intermediate switch 5 is provided at a corresponding positions. Therefore, when the drawer 2 is at the completely open position, the actuator 7 operates the completely open position detection switch 10 (FIG. 2). The actuator 7 operates the intermediate switch 5 in the course of closing the door from the completely open state. Then, the movable lever 9 engages with the latch hook 11 at the completely close position to operate the completely closed position detection switch 8 (FIG. 4). The intermediate position detection switch (intermediate switch) 5 is set at such a position where the user's finger or hand could become caught in the door at the time of closing the door.

When the drawer 2 is pushed into the container as shown in FIG. 4 from the open state of FIG. 2, the movable lever 9 provided at the rearmost position of the movable rail 4*b* turns on the completely closed position detection switch 8. When the drawer 2 is pulled out, the movable lever 9 is disengaged from the completely closed position detection switch 8 to return to the state of FIG. 3 and turn off the completely closed position detection switch 8. Accordingly, the power supply to the microwave generator is cut off not only after cooking under heating but also during the cooking to disable the generation of the microwaves. The completely closed position detection switch 8 can be used as one of the switches for controlling the oscillation and cutoff of the microwaves. For the actual operation of the cooking heater, a user operates another switch (not shown) to input settings. Further, a main switch for starting the cooking heater is separately provided to prevent a user from operating the main switch by mistake.

FIG. 5 is a block diagram focused on how to control a moving speed of the door the sliding-drawer type cooking heater as shown in FIGS. 1 to 4. A microcomputer 20 receives a signal representative of a door position detected by the completely closed position detection switch 8, the intermediate switch 5, and the completely open position detection switch 10. The microcomputer 20 also receives an input signal from an operating device 28 provided to the sliding-drawer type cooking heater. The microcomputer 20 includes an opening/closing door position calculating device 21 for calculating a current position of the door, an operation instructing device 22 for instructing driving device 25 to start/stop opening the door, thereby instructing the moving direction of the door, and instructing the moving speed of the door, a lock determining device 23 for determining a locked state of the driving device 25, and a speed storage device 24 for receiving a speed to be instructed by the operation instructing device 22 and storing the speed with a speed setting device 27. A rotational position of a DC motor as the driving device 25 is detected by a rotational sensor 26, and a detection signal is input to the opening/closing door position calculating device 21 and the lock determining device 23.

The torque of the DC motor is converted into an opening/closing motion of the door by means of an appropriate movement converting mechanism. In the sliding-drawer type cooking heater, the torque of the DC motor is converted into linear movement of the drawer. The opening/closing door position calculating device 21 can calculate a rough position of the drawer between the switches only with the detection signals of the switches 5, 8, and 10. It is possible to calculate a correct door position with the use of a rotational speed signal from the rotational sensor 26 and to detect that the drawer has reached the completely closed position or intermediate position. In the event of failure of the switches 5, 8, and 10, the rotational speed signal is substituted for the detection signals of the switches 5, 8, and 10. Information about the door position obtained with the opening/closing door position calculating device 21 is sent to the operation instructing device 22 to instruct the driving device 25 to select an appropriate rotational speed out of speeds stored in the speed storage device 24 and a corresponding rotation direction. When receiving a lock signal indicating an abrupt deceleration from the rotation sensor 26 irrespective of the speed instructed by the operation instruction device 22, the lock determining device 23 determines that the driving device 25 has collided against an obstacle to close a lock, and instructs the operation instructing device 22 to cause the driving device 25 to stop the movement of the door and instantly move the door in the opposite direction.

Figure 6:
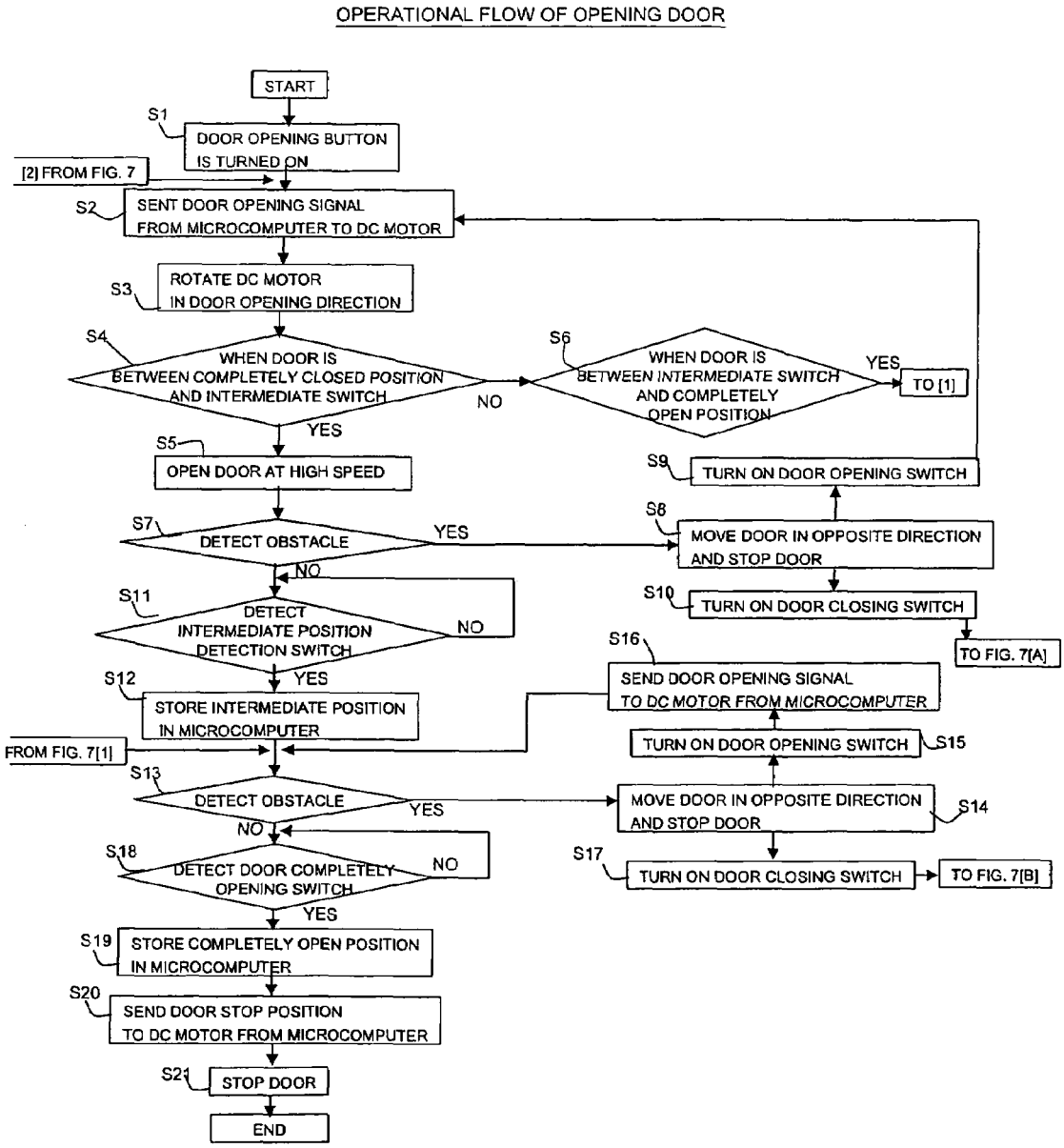
FIG. 6 is a flowchart showing an example of a control flow of a controlling unit in the cooking heater according to the embodiment of the present invention at the time of opening a door.

FIG. 6 is a flowchart showing a door opening operation of the sliding-drawer type cooking heater as shown in FIGS. 1 to 4. When the user operates a switch for opening the door as a door opening button to turn on the switch (step 1 (abbreviated to S1), the same applies to the following). In response to the switch being turned on, the microcomputer sends a door opening position indicative of the current door position to a DC motor as a driving motor (S2), and the torque of the DC motor is transmitted in the direction of opening the door in response to the door opening signal (S3). The door starts opening with the rotation of the DC motor so as to determine whether or not the current position of the door is between the completely closed position and the intermediate position at which the intermediate switch is provided (S4). If the determination result of S4 is positive, the rotational speed is set at a high speed to open the door at the high speed (S5). If the determination result is negative in S4, it is determined whether or not the current position of the door is between the intermediate position and the completely open position (S6). If the determination result is positive in S6, the process shifts to S13 of FIG. 6[1]. In the case where the door opens at the high speed in S5, it is determined whether or not the obstacle is detected (S7). If the determination result is positive in S7, that is, the obstacle is detected, the door is moved in the opposite direction and stopped (S8). After that, if the door opening switch is turned on (S9), the process returns to S2. If the door closing switch is turned on (S10), the process is shifted to FIG. 7[A] (S43). When the obstacle is detected, for example, when the user's finger or hand is caught in the door, the door is moved in the opposite direction and then stopped, and thus separated from the obstacle to wait for the next instruction. Hence, it is possible to secure a higher level of safety for the user even when an obstacle is detected.

If no obstacle is detected in S7, it is determined whether or not the intermediate switch is turned on (S11). If the intermediate switch is not detected, the process of S11 is repeated until the intermediate switch is turned on. In the course of repeating the process of S11, the intermediate switch is detected. If the determination result is positive in S11, the microcomputer stores the intermediate position (S12), and then continues the door opening operation to determine whether or not the obstacle is detected (S13). When an obstacle is detected, the door is moved in the opposite direction and stopped (S14). After that, when the user turns on the door opening switch (S15), the microcomputer sends a door opening signal to the DC motor to open the door (S16), and the process returns to S13. When the user turns on the door closing switch (S15), the process is shifted to FIG. 7[B] (S35). If an obstacle is not detected in S13, it is determined whether or not the completely door opening switch has been turned on (S18). If it is not detected that the completely door opening switch is turned on, the process of S18 is repeated until the door completely opening switch is turned on. In the course of repeating the process of S18, if the determination result is positive in S18, that is, the door completely opening switch is turned on, the microcomputer stores the completely opening position (S19), and the microcomputer sends the door stopping signal to the DC motor (S20). As a result, the door stops (S21).

Although not shown in the control flow, if the user feels danger during the operation of opening the door, the door can be stopped with the door closing button or opening button pressed under control anytime in these series of operations.

During the normal operation of the position detection switch, the door operates in accordance with the flowchart. Even in failure of the position detection switch, the microcomputer monitors the rotational speed signal from the DC motor at all times to control the door in a way similar to the operation of the flowchart. Further, an erroneous operation is prevented under abnormal conditions through two types of signals, the detection signal of the switch and the rotational speed signal of the motor.

Figure 7:
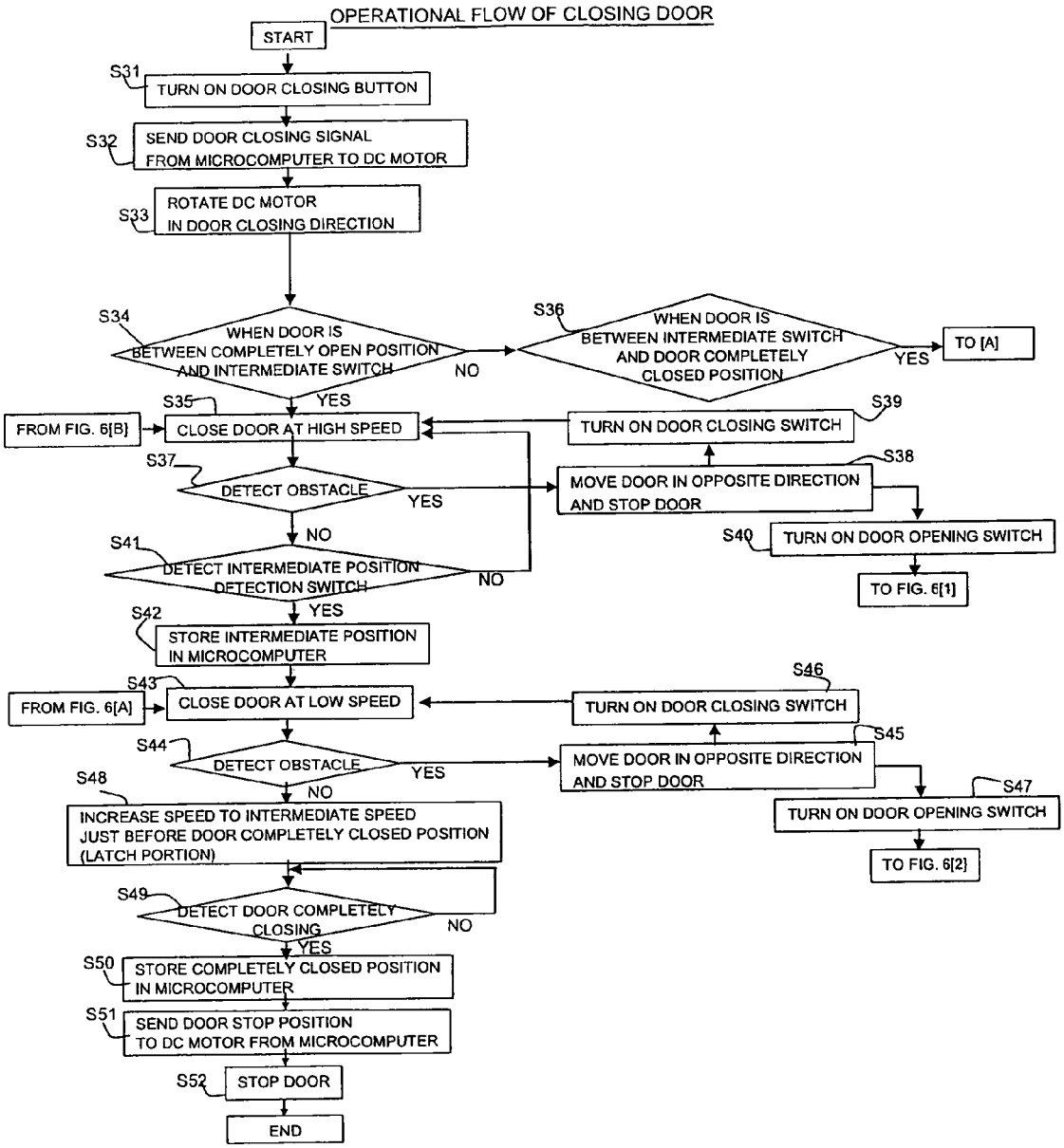
FIG. 7 is a flowchart showing another example of the control flow of a controlling unit in the cooking heater according to the embodiment of the present invention at the time of opening a door.

FIG. 7 is a flowchart of the operation of closing the door. The user presses the door closing button, for example, to turn on the door closing switch (S31). In response to the switch being turned on, the microcomputer sends the door closing signal corresponding to the current door position to the DC motor (S32). The DC motor applies the torque in the direction of closing the door in accordance with the door closing signal (S33). The door starts closing along with the rotation of the DC motor, and it is determined whether or not the current door position is between the completely open position and the intermediate position at which the intermediate switch is provided (S34). If the determination result is positive in S34, the rotational speed of the DC motor is set to a high speed to close the door at the high speed (S35). This is because the door is not closed up to the intermediate (nearby) position at which the finger or hand is caught in the door, so safety is ensured even if the door is closed to such a position at high speeds. If the determination result is negative in S34, it is determined whether or not the current door position is between the intermediate position and the completely closed position (S36). If the determination result is positive in S36, the process is shifted to FIG. 7[A] (S43).

If the door is closed at high speeds in S35, whether or not an obstacle is detected is determined (S37). If the determination result is positive in S37, that is, an obstacle is detected in front of the door that is closing at high speeds, the door is moved in the opposite direction and stopped (S38). After that, if the door closing switch is turned on (S39), the process returns to S35, and if the door closing switch is turned on (S40), the process is shifted to FIG. 6[1] (S13).

If no obstacle is detected in the judgment of S37, that is, no obstacle is detected during the high-speed closing operation, it is determined whether or not the intermediate switch provided ahead of the door completely closed position (S41) has been turned on, when it is detected that the intermediate switch has not been turned on, the process of S41 is repeated until the intermediate switch is turned on. In the course of repeating the process of S41, if the intermediate switch is detected and the determination result is positive, the microcomputer stores the intermediate position (S42) to lower the door closing speed and close the door at low speeds (S43). This is because the door is closed up to the intermediate (nearby) position at which a finger or hand may be caught in the door, but the closing speed is sufficiently reduced, so even if the user's finger or hand is caught in the door, the user feels no pain. Here, the process of S43 is executed when the door is moved in the opposite direction and stopped in S8, and the door closing switch is turned on in S10. While the same operation is continued at a lower speed, it is determined whether or not an obstacle is detected (S44). If an obstacle is detected, the door is moved in the opposite direction (so as to open) and stopped (S45). After that, when the user turns on the door closing switch (S46), the process returns to S43. If the user turns on the door closing switch (S47), the process is shifted to FIG. 6[2] (S2).

If an obstacle is not detected in the determination of S44, the rotational speed of the motor is increased to an intermediate speed (S48). In the sliding-drawer type cooking heater, the opening/closing door, that is, the drawer 2 has the latch structure that is secured in the completely closed position by the latch head being positioned beyond the latch hook to reliably preventing the opening/closing door from erroneously opening during the cooking under heating. The latch head is hard to move beyond the latch head at the lower speed of the drawer 2. That, the rotation speed of the motor that is lowered, and the door is closed up to almost the completely closed position at which the finger is barely caught. Then, the rotation speed is increased to some extent just before the completely closed position. Thus, the latch head is made to move beyond the latch hook, so that the door can be completely closed. It is determined whether or not the door completely closing switch is turned on (S49). If it is determined that the door completely opening switch has been turned on, the processing of S49 is repeated until the door completely opening switch is detected. In the course of repeating the process of S49, it is detected whether the door completely closing switch has been turned on. If the determination result is positive in S49, the microcomputer stores the completely closed position (S50), and the microcomputer sends the door stop position to the DC motor (S51). As a result, the door is stopped (S52).

In the flow of the door repeating the same operation, a user may feel a danger of being caught between the intermediate position and the door completely closed position and press the door opening button or door closing button. If the user presses the door closing button, the door is moved in the opposite direction (so as to open) and then stopped. However, if the user presses the door closing button, the above operation is prohibited, so the same operation can be continued at the same speed, that is, lower speed.

As described above, according to the present invention, it is possible to provide the cooking heater with an automatic opening/closing door, which provides high safety for a user. The embodiment of the present invention, which is applied to the sliding-drawer type heating cooker is described above, but the present invention is, needless to say, applicable to a large hinged door. The cooking heater may be a composite cooking heater that has an integrated cooktop, sliding-drawer type microwave oven and electric oven.

What is claimed is:

1. A cooking heater comprising:

a heating chamber for cooking an object;

an opening/closing door providing access to the heating chamber; and a microcomputer for receiving a signal representative of a door position, the microcomputer comprising an opening/closing door position calculating device for calculating a current position of the door, an operation instructing device for instructing a driving device to start/stop opening the door, a lock determining device for determining a locked state of the driving device, and a speed storage device for receiving a speed to be instructed by the operation instructing device and storing the speed with a speed setting device, wherein in response to detection of an obstacle to a movement of the opening/closing door that is opening/closing, the opening/closing door is moved in an opposite direction, the opening/closing door is moved in the opposite direction in accordance with the detection of the obstacle and then the opening/closing door is temporarily stopped, and the cooking heater is a sliding drawer-type cooking heater having the opening/closing door, a heating container capable of containing an object to be heated, and a drawer that can be pushed in or pulled out from a heating main body.

2. The cooking heater according to claim 1, further comprising:

a motor for generating a torque that is converted into an opening/closing movement of the opening/closing door, wherein detection of a lock signal indicating that transmission of the torque from the motor has stopped corresponds to detection of the obstacle.

3. A cooking heater comprising:

a heating chamber for cooking an object;

an opening/closing door providing access to the heating chamber; and a microcomputer for receiving a signal representative of a door position, the microcomputer comprising: an opening/closing door position calculating device for calculating a current position of the door, an operation instructing device for instructing a driving device to start/stop opening the door, a lock determining device for determining a locked state of the driving device, and a speed storage device for receiving a speed to be instructed by the operation instructing device and storing the speed with a speed setting device, wherein during a closing operation of the opening/closing door, a closing speed of the opening/closing door is lowered at a position ahead of a completely closed position at which the opening/closing door is completely closed, the opening/closing door includes a latch structure that secures the opening/closing door in the completely closed position by a latch head moving beyond a latch hook, and the closing speed of the opening/closing door, which is lowered, is increased at a position immediately before the completely closed position, and the cooking heater is a sliding drawer-type cooking heater having the opening/closing door, a heating container capable of containing an object to be heated, and a drawer that can be pushed in or pulled out from a heating main body.

4. The cooking heater according to claim 3, further comprising:

a plurality of switches provided to each of the completely closed position and the position ahead of the completely closed position, wherein the detection switches are actuated by an actuator moving along with the opening/closing operation of the opening/closing door to detect that the opening/closing door reaches the completely closed position and the position ahead of the completely closed position.

5. The cooking heater according to claim 3, further comprising:

a motor for generating a torque that is converted into an opening/closing movement of the opening/closing door, wherein it is detected that the opening/closing door reaches the completely closed position and the position ahead of the completely closed position on the basis of a rotation signal of the motor.

* * * * *